US010286432B2

(12) United States Patent
Chung et al.

(10) Patent No.: US 10,286,432 B2
(45) Date of Patent: May 14, 2019

(54) CONTINUOUS CASTING AND ROLLING APPARATUS AND METHOD

(71) Applicant: POSCO, Pohang-si, Gyeongsangbuk-do (KR)

(72) Inventors: Jea-Sook Chung, Gwangyang-si (KR); Il-Sin Bae, Gwangyang-si (KR); Suk-Cheol Song, Gwangyang-si (KR); Young-Ju Ko, Gwangyang-si (KR); Kyeong-Mi Park, Gwangyang-si (KR); Jong-Hwan Lee, Seoul (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 330 days.

(21) Appl. No.: 15/107,904

(22) PCT Filed: Nov. 12, 2014

(86) PCT No.: PCT/KR2014/010847
§ 371 (c)(1),
(2) Date: Jun. 23, 2016

(87) PCT Pub. No.: WO2015/099288
PCT Pub. Date: Jul. 2, 2015

(65) Prior Publication Data

US 2016/0339490 A1 Nov. 24, 2016

(30) Foreign Application Priority Data

Dec. 23, 2013 (KR) ..... 10-2013-0161714

(51) Int. Cl.
*B21B 1/46* (2006.01)
*B21B 1/26* (2006.01)
(Continued)

(52) U.S. Cl.
CPC ..... *B21B 1/26* (2013.01); *B21B 1/46* (2013.01); *B21B 45/004* (2013.01); *B22D 11/126* (2013.01); *B22D 11/1206* (2013.01)

(58) Field of Classification Search
CPC ..... B21B 1/46; B21B 1/463; B21B 39/00; B21B 39/004; B21B 39/04; B21B 39/12;
(Continued)

(56) References Cited

U.S. PATENT DOCUMENTS 6,463,652 B1 10/2002 Narushima et al.
8,025,092 B2 9/2011 Arvedi
(Continued)

FOREIGN PATENT DOCUMENTS

CN 101045239 A 10/2007
CN 201024195 Y 2/2008
(Continued)

OTHER PUBLICATIONS

International Search Report dated Feb. 13, 2015 issued in International Patent Application No. PCT/KR2014/010847.
(Continued)

*Primary Examiner* — Edward T Tolan
(74) *Attorney, Agent, or Firm* — Morgan Lewis & Bockius LLP

(57) ABSTRACT

A continuous casting and rolling apparatus according to one embodiment of the present invention comprises: a continuous casting apparatus for producing a steel sheet; a roller, linked to the continuous casting apparatus, for receiving the steel sheet; and a push heat unit, connected to the continuous casting apparatus and/or the roller, for selectively carrying outing heating work or removal work with respect to a portion of the steel sheet. Also, a continuous casting and rolling method according to another embodiment of the present invention may comprise: a continuous casting step
(Continued)

for producing a steel sheet; and a selective performance step for selectively carrying out heating work or removal work with respect to a portion of the steel sheet.

5 Claims, 9 Drawing Sheets

(51) Int. Cl.
*B22D 11/12* (2006.01)
*B21B 45/00* (2006.01)
*B22D 11/126* (2006.01)

(58) Field of Classification Search
CPC ..... B21B 45/004; B21B 1/26; B22D 11/126; B22D 11/1206; B22D 11/1284
See application file for complete search history.

(56) References Cited

U.S. PATENT DOCUMENTS

| | | | | |
|---|---|---|---|---|
| 8,257,643 | B2 | 9/2012 | Benedetti | |
| 8,365,806 | B2 * | 2/2013 | Rosenthal | B21B 1/46 164/263 |
| 2008/0028813 | A1 * | 2/2008 | Arvedi | B21B 1/463 72/226 |
| 2010/0275667 | A1 * | 11/2010 | Seidel | B21B 1/46 72/127 |
| 2016/0243602 | A1 * | 8/2016 | Benedetti | B21B 1/46 |

FOREIGN PATENT DOCUMENTS

| | | | |
|---|---|---|---|
| CN | 201227658 | Y | 4/2009 |
| CN | 101529974 | A | 9/2009 |
| CN | 101925420 | A | 12/2010 |
| CN | 102345008 | A | 2/2012 |
| CN | 102921727 | A | 2/2013 |
| JP | S55-022422 | A | 2/1980 |
| JP | 6-092001 | A | 11/1994 |
| JP | 11-347602 | A | 12/1999 |
| JP | 2002-219501 | A | 8/2002 |
| JP | 2009-520882 | A | 5/2009 |
| KR | 2010-0078425 | A | 7/2010 |
| KR | 10-0986092 | B1 | 10/2010 |
| KR | 10-2013-0075799 | A | 7/2013 |
| RU | 2010122586 | A | 12/2011 |
| RU | 2010135761 | A | 2/2012 |
| SU | 1292909 | A1 | 2/1987 |

OTHER PUBLICATIONS

Russian Office Action dated Sep. 20, 2017 issued in Russian Patent Application No. 2016130054, with English translation.
Chinese Office Action dated Mar. 15, 2017 issued in Chinese Patent Application No. 201480070443.6.
Chinese Office Action dated Jun. 13, 2018 issued in Chinese Patent Application No. 201480070443.6 (with English translation).

* cited by examiner

【FIG. 1】
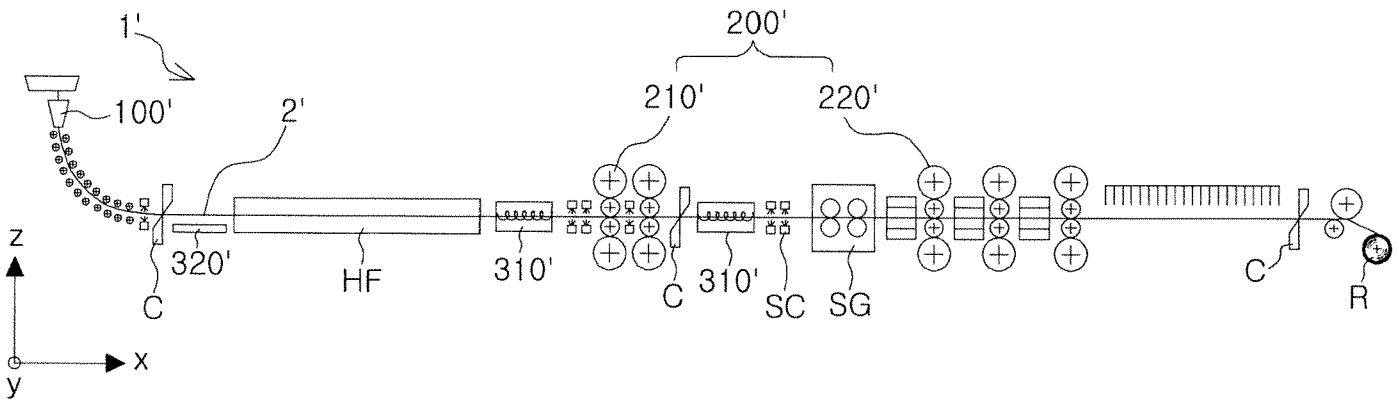

【FIG. 2】
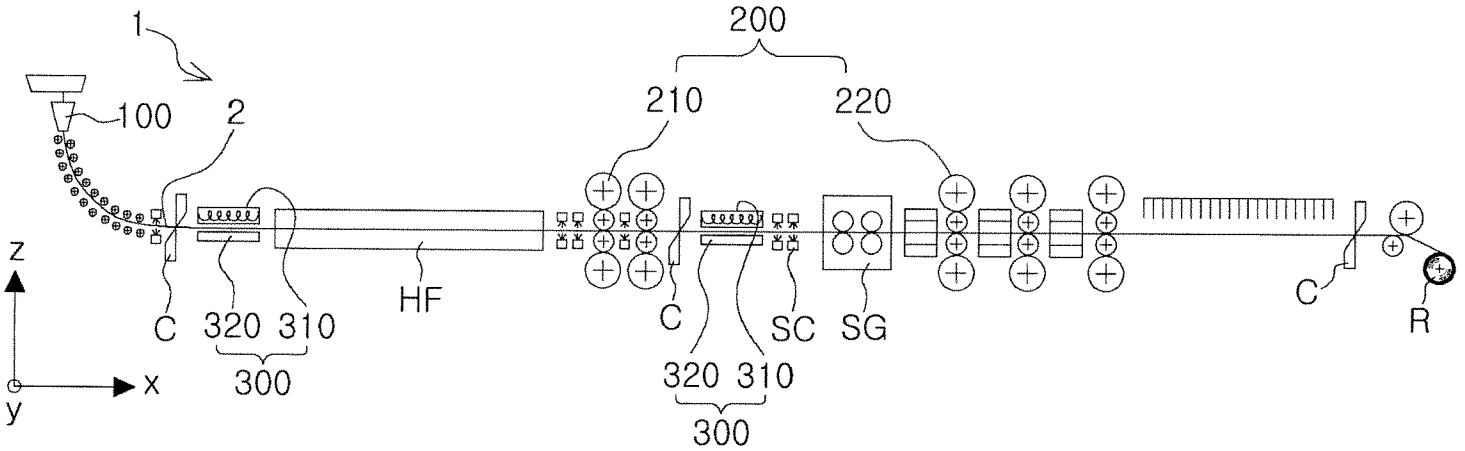

【FIG. 3】
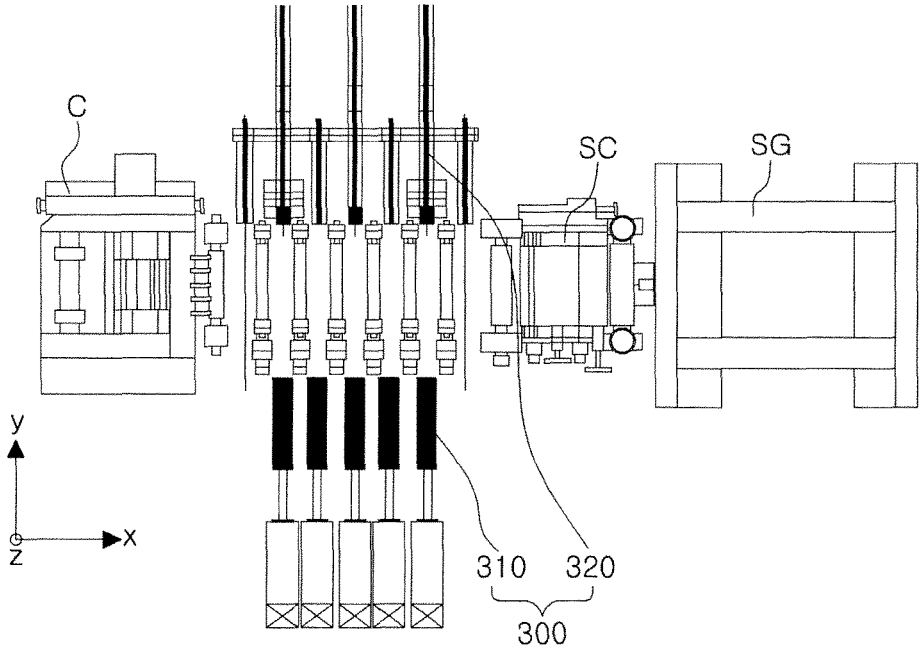
【FIG. 4】
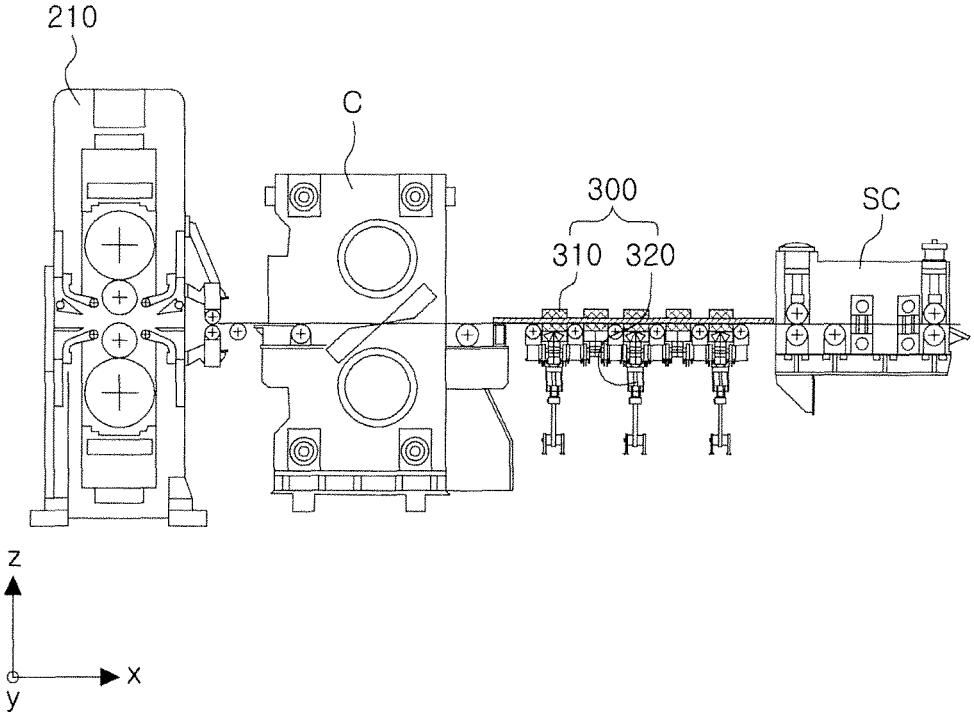

【FIG. 5】
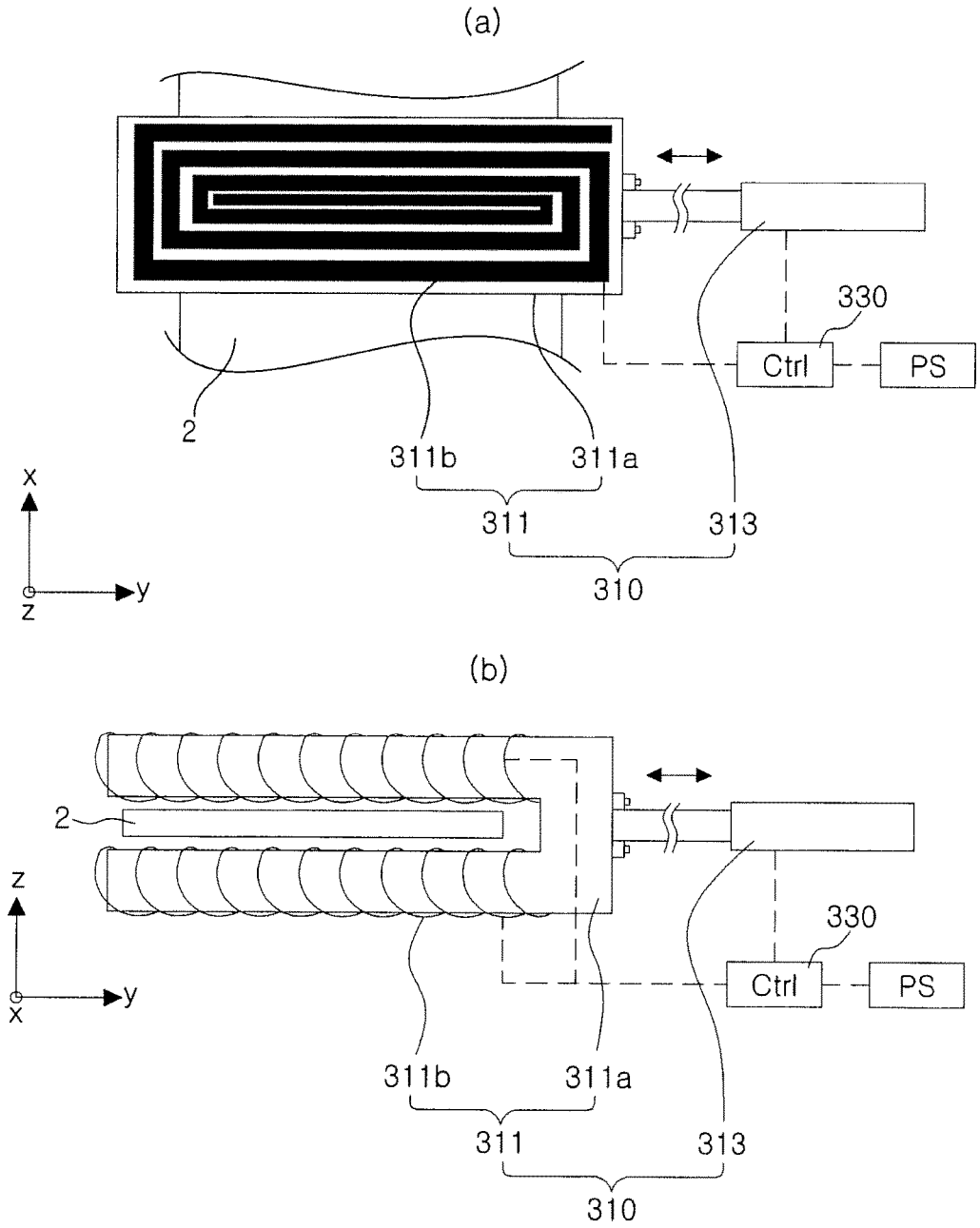

【FIG. 6】
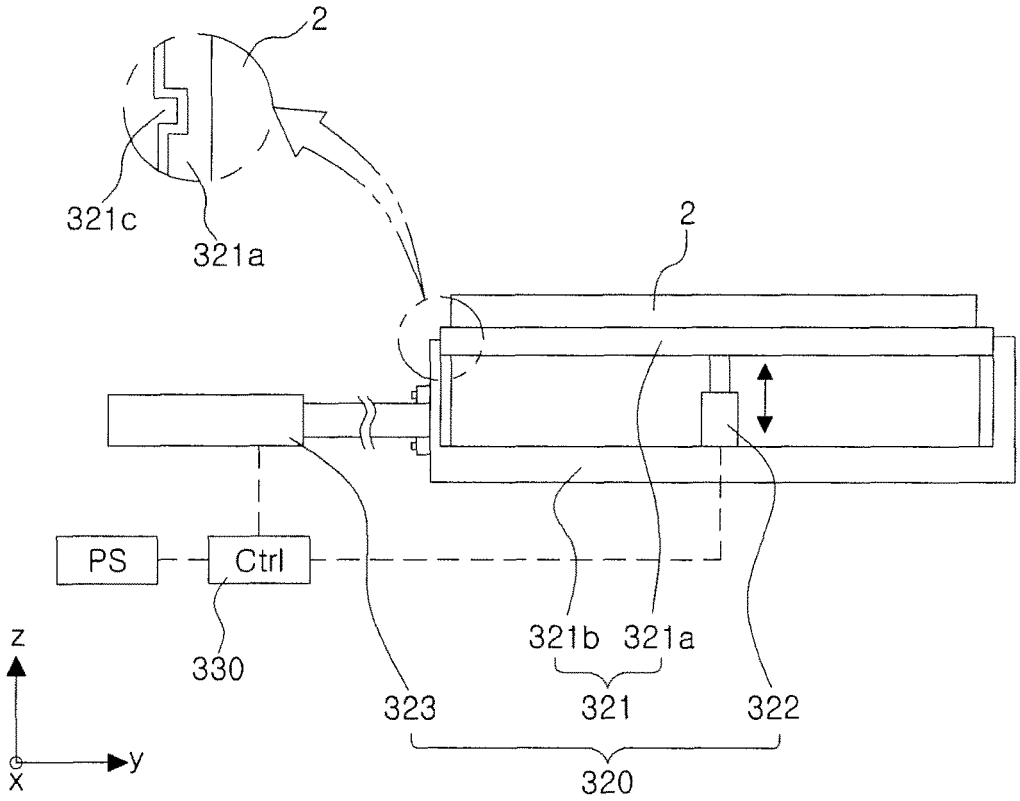
【FIG. 7a】
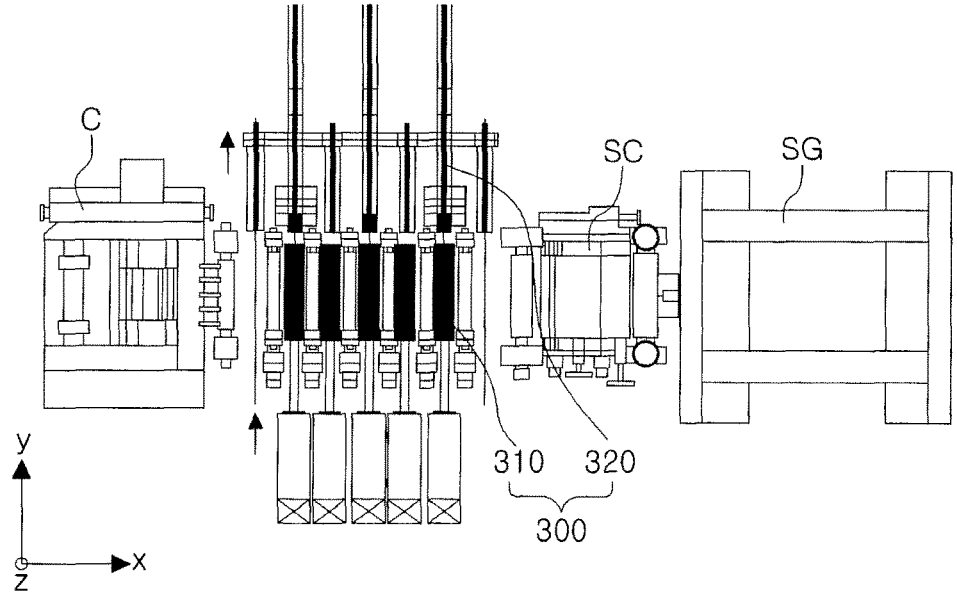

【FIG. 7b】
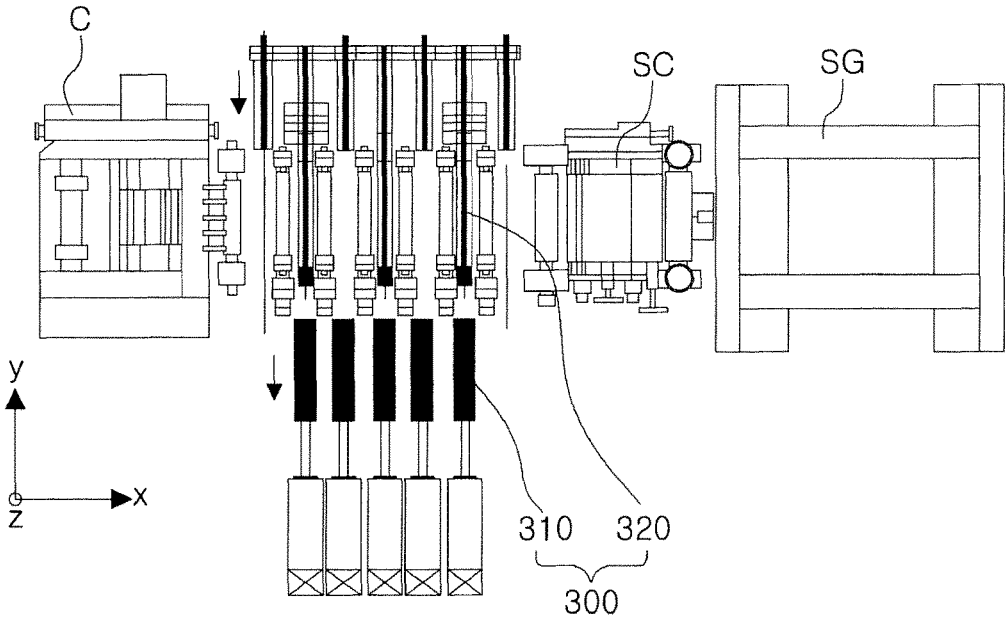
【FIG. 7c】
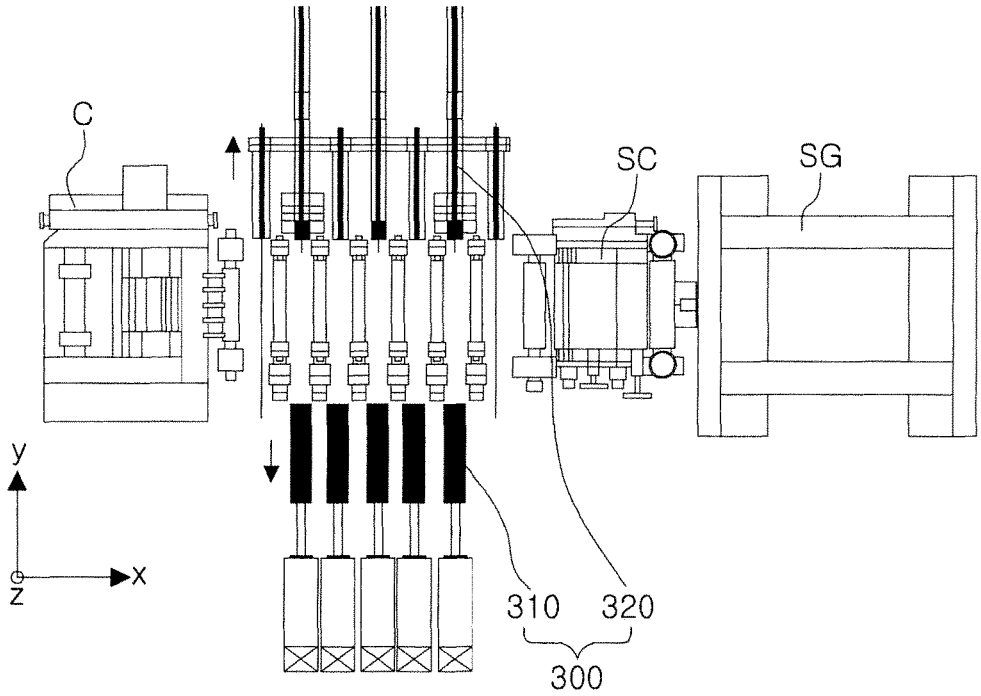

【FIG. 8a】
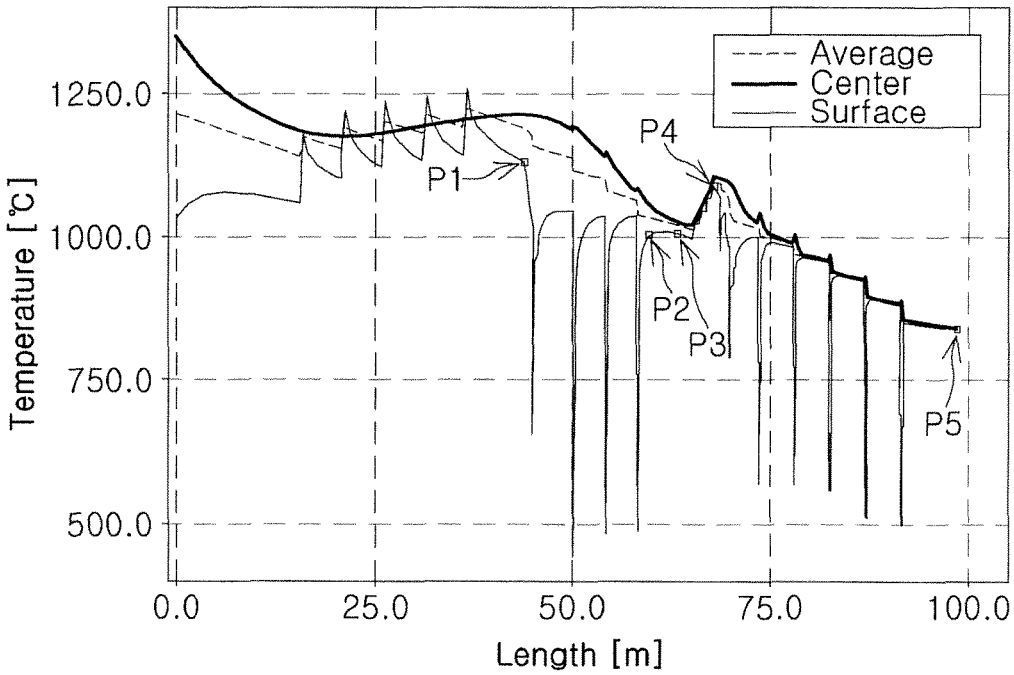
【FIG. 8b】
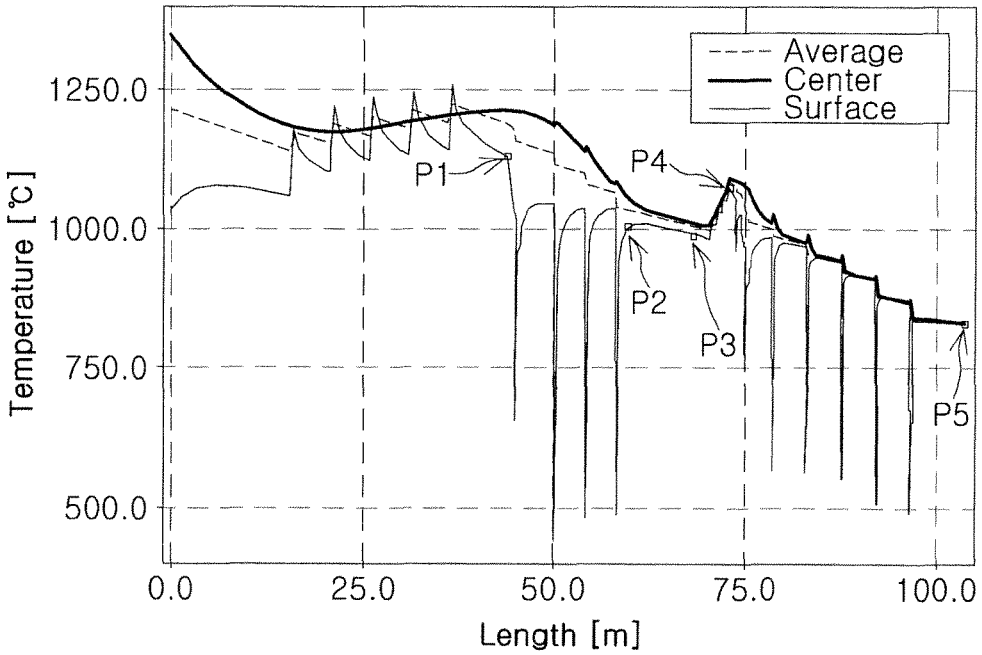

【FIG. 8c】
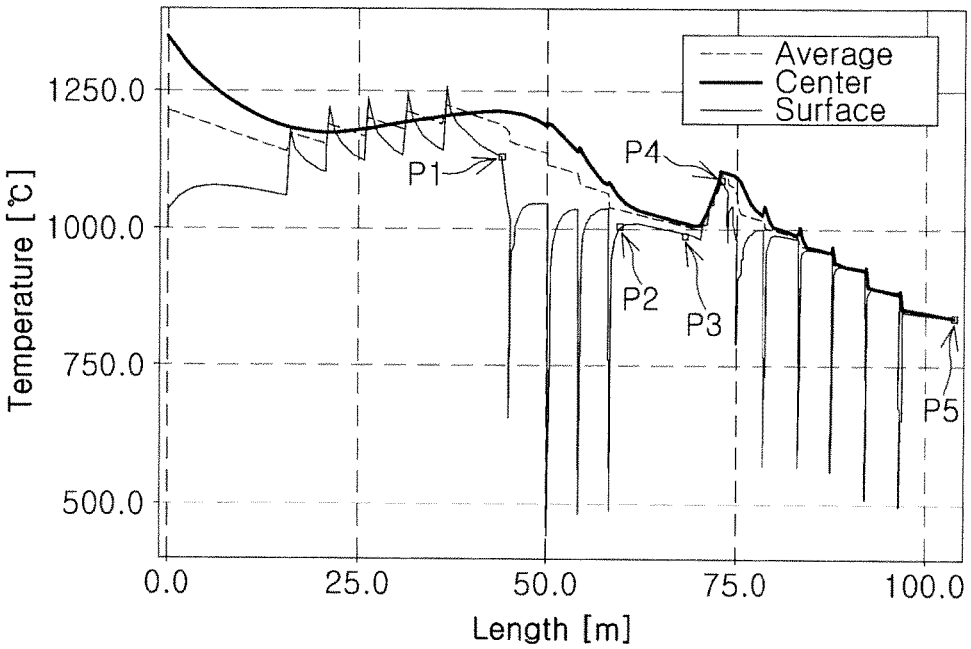

【FIG. 9】
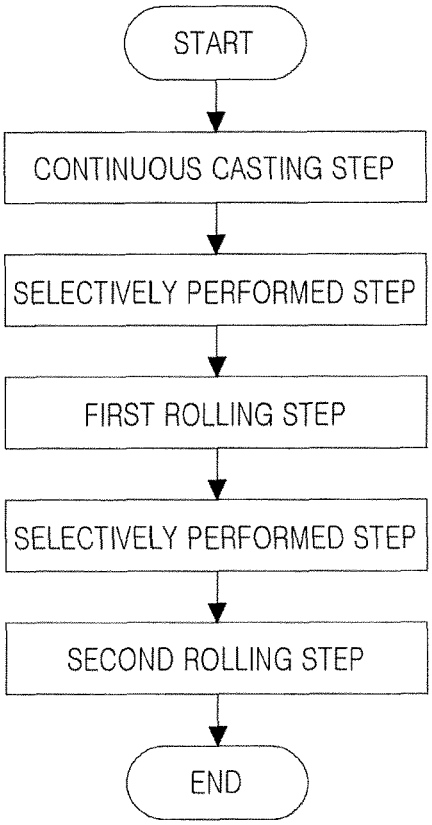
【FIG. 10】
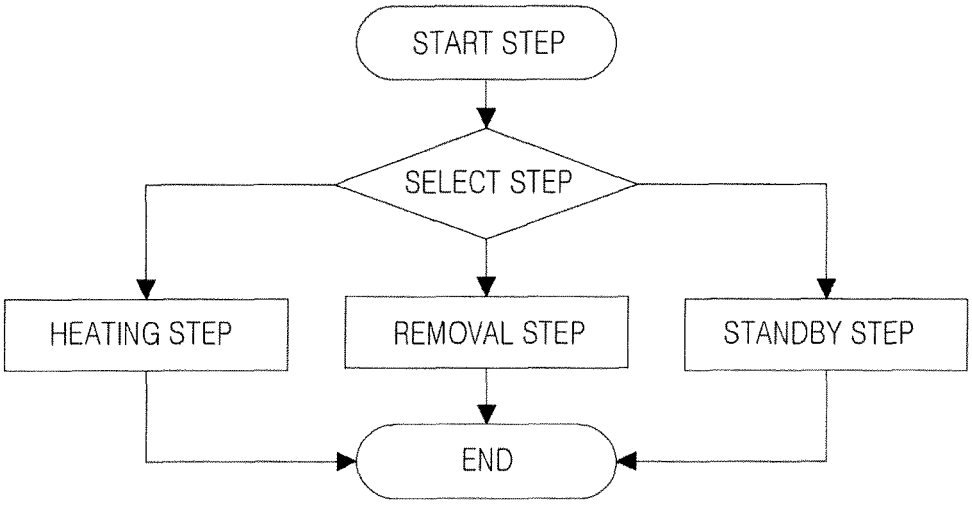

CONTINUOUS CASTING AND ROLLING APPARATUS AND METHOD

RELATED APPLICATIONS

This application is the U.S. National Phase under 35 U.S.C. § 371 of International Application No. PCT/KR2014/010847, filed on Nov. 12, 2014, which in turn claims the benefit of Korean Patent Application No. 10-2013-0161714, filed on Dec. 23, 2013, the disclosure of which applications are incorporated by reference herein.

TECHNICAL FIELD

The present invention relates to a continuous casting and rolling apparatus and method, and more particularly, to an invention capable of performing a heating operation and a removal operation on a steel sheet for rolling.

BACKGROUND ART

A process of performing rolling using a high temperature solidified cast part in a continuous casting device is currently widely used, due to equipment costs and operating costs thereof being more inexpensive than conventional processes.

In addition to the process of continuously performing casting and rolling, a batch process capable of performing rolling separately from the above-mentioned continuous casting can also be performed, which is described in detail in Korean Laid-open Patent Publication No. 2008-0044897.

Meanwhile, as illustrated in FIG. 1, it is possible to provide a remover 320' for cutting and removing a defective steel sheet, and a heater 310' for heating a steel sheet 2' before transport thereof to a hot roller 200' for rolling.

That is, conventionally, a remover (push & piler) 320" for cutting the steel sheet 2' produced in the continuous casting device 100' or the steel sheet 2' passing through a first rolling section 210' at a fixed length and for laminating the steel sheet 2' to the outside of a transport line, and a heater 310' for heating or heat-insulating the steel sheet 2' have been installed in different locations in a transport direction x of the steel sheet 2', respectively.

Further, a layout of a transport path has been formed in which, regardless of being in the endless rolling mode or the batch rolling mode, at least one of a holding furnace (HF) and the heater 310' has been installed at a rear end of the continuous casting device 100', and the steel sheet 2' has been provided to the second rolling section 220' via another heater 310' installed at a rear end of the first rolling section 210' provided after that.

However, the shorter the distance of the layout from the continuous casting device 100' to the second rolling section 220 is, the more advantageous it is, since the temperature loss of the steel sheet 2' during rolling is less. Because the remover 320' and the heater 310' may be located at different locations on the transport path of the steel sheet 2', the layout has become elongated by an amount equal to the arrangement length of the remover 320 or the heater 310', and there has been a problem of an increase in temperature.

That is, in order to be able to perform the endless rolling and the batch rolling at the same time, there is a need for a space in which the steel sheet (slab) cut to a length capable of producing a single rolled coil in front of the first rolling section 210' can be disposed. Although a heater 310' for compensating for a drop in temperature and a remover 320' for cutting and piling up the steel sheet 2' have been required in the space, each of the heater 310' and the remover 320' is fixed at a different location on the transport path of the steel sheet 2', which has made the layout longer.

In addition, since the heater 310' for heating or insulating for finish rolling and the remover 320' for removing a defective steel sheet 2' which may be generated in the first rolling section 210' are also required to be installed between the first rolling section 210' and the second rolling section 220', the layout for the rolling is further elongated, and the temperature loss may further increase.

Meanwhile, since an output side steel sheet 2' of the first rolling section 210' may be vertically bent (warped) or horizontally bent (cambered) depending on the temperature conditions, there has also been a problem of a risk of damaging the heater 310' or the remover 320' installed on the output side of the first rolling section 210'.

Accordingly, there has been a need for a research into continuous casting and rolling apparatuses and methods for solving the aforementioned problems.

DISCLOSURE

Technical Problem

An aspect of the present invention provides a continuous casting and rolling apparatus and method capable of performing an efficient continuous casting and rolling process, by reducing a movement path of the steel sheet produced in the continuous casting device to reduce the temperature loss in a rolling procedure.

Technical Solution

According to an aspect of the present invention, there is provided a continuous casting and rolling apparatus that includes a continuous casting device producing a steel sheet; a hot roller provided to be linked to the continuous casting device to receive the steel sheet; and a push-heat unit linked to at least one of the continuous casting device and the hot roller and is provided to selectively perform one of a heating operation and a removal operation on some of the steel sheet.

Further, the push-heat unit of the continuous casting and rolling apparatus according to an aspect of the present invention may include a heater provided on one side of the steel sheet in a widthwise direction to move from one side to the other side of the steel sheet in the widthwise direction so as to heat the steel sheet, and a remover provided on the other side of the steel sheet in the widthwise direction to move from the other side to one side of the steel sheet in the widthwise direction so as to remove the cut steel sheet that is cut by a cutter located at a rear end of a first rolling section linked to a rear end of the continuous casting device.

Further, the push-heat unit of the continuous casting and rolling apparatus according to an aspect of the present invention may provide the heater and the remover to face each other on both sides of the same position in a transport direction of the steel sheet.

Further, the heater of the continuous casting and rolling apparatus according to an aspect of the present invention may include a coil section provided by being connected to a power supply unit to control a heating temperature, and a coil transport section that moves the coil section of the steel sheet in the widthwise direction.

Further, the coil section of the continuous casting and rolling apparatus according to an aspect of the present invention includes a core provided in a "U" shape to heat a top and a bottom of the steel sheet, and a coil which is provided by being wound around the core.

Further, the remover of the continuous casting and rolling apparatus according to an aspect of the present invention may include a support section provided to support the cut steel sheet in contact with the bottom of the cut steel sheet, a support vertical transport section for vertically moving the support section, and a horizontal transport section for moving the support section of the steel sheet in the widthwise direction.

Furthermore, the hot roller of the continuous casting and rolling apparatus according to an aspect of the present invention includes a first rolling section provided to be connected to the rear end of the continuous casting device, and a second rolling section provided to be connected to the rear end of the first rolling section, and the push-heat unit may be provided in at least one of a portion between the rear end of the continuous casting device and a front end of the first rolling section, and a portion between the rear end of the first rolling section and a front end of the second rolling section.

Further, according to another aspect of the present invention, there is provided a continuous casting and rolling method that includes a continuous casting step of producing a steel sheet; a rolling step of pressing the steel sheet down; and a selectively performed step of selectively determining whether to perform one of a heating operation and a removal operation on some of the steel sheet, at the same position on a transport path of the steel sheet.

Further, the selectively performed step of the continuous casting and rolling method according to another aspect of the present invention may selectively activate one of a heating step of heating a portion of the steel sheet, a removal step of removing the cut steel sheet cut in the transport direction of the steel sheet, and a standby step of not performing the heating step and the removal step.

Further, the rolling step of the continuous casting and rolling method according to another aspect of the present invention may include a first rolling step, and a second rolling step performed after the first rolling step, wherein the selectively performed step may be performed prior to at least one of the first rolling step and the second rolling step.

Advantageous Effects

According to the continuous casting and rolling apparatus and method of an aspect of the present invention, the heating operation of the steel sheet and the removal operation of some of the steel sheet may be selectively performed, in the same position on the transport path of the steel sheet.

Thereby, since it is possible to reduce the length of the layout of the continuous casting and rolling process, heat loss of the steel sheet during the continuous casting and rolling process may be reduced.

Therefore, the process may be efficiently performed, by reducing the consumption of energy required for the continuous casting and rolling process.

Meanwhile, by adjusting the provision of the heater for heating the steel sheet or the remover for performing the removal operation on the transport path of the steel sheet, the steel sheet may be prevented from deviating from the path due to bending or the like to collide with the heater or the remover.

DESCRIPTION OF DRAWINGS

FIG. 1 is a diagram illustrating a continuous casting and rolling apparatus according to the prior art.

FIG. 2 is a side view of the continuous casting and rolling apparatus of the present invention.

FIG. 3 is a plan view illustrating a push-heat unit in the continuous casting and the rolling apparatus of the present invention.

FIG. 4 is a side view illustrating a periphery of the push-heat unit in the continuous casting and the rolling apparatus of the present invention.

FIG. 5 is a front view illustrating a heater in the continuous casting and the rolling apparatus of the present invention.

FIG. 6 is a front view illustrating a remover in the continuous casting and rolling apparatus of the present invention.

FIGS. 7*a* to 7*c* are plan views illustrating an operating state of the push-heat unit.

FIGS. 8*a* to 8*c* are graphs illustrating a temperature change of the steel sheet depending on the position of the continuous casting and rolling apparatus by comparison between the prior art and the present invention.

FIGS. 9 and 10 are flowcharts illustrating the continuous casting and rolling method of the present invention.

BEST MODE

Hereinafter, embodiments of the invention will be described in detail with reference to the accompanying drawings. The drawings are attached hereto to help explain exemplary embodiments of the invention, and the present invention is not limited to the drawings and embodiments. In the drawings, some elements may be exaggerated, reduced in size, or omitted for clarity or conciseness.

A continuous casting and rolling apparatus and method of the present invention relates to an invention whereby an entire movement path of a steel sheet 2 can be reduced, thereby reducing heat loss in the process of rolling of a steel sheet 2, by selectively performing the heating operation and the removal operation on the steel sheet 2 for rolling in the same position.

Therefore, by reducing the consumption of energy required by the continuous casting and rolling process, it is possible to carry out the process efficiently.

Meanwhile, by adjusting the provision of the heater 310 for heating the steel sheet 2 or the remover 320 for performing the removal operation on the transport path of the steel sheet 2, it is possible to prevent a problem in which the steel sheet 2 deviates from the path due to bending or the like to collide with the heater 310 or the remover 320.

Specifically, FIG. 2 is a side view illustrating a continuous casting and rolling apparatus 1 of the present invention, and FIG. 4 is a side view illustrating the periphery of the push-heat unit 300 in the continuous casting and rolling apparatus 1 of the present invention.

Referring to FIGS. 2 and 4, the continuous casting and rolling apparatus 1 according to an embodiment of the present invention may include a continuous casting device 100 producing a steel sheet 2; a hot roller 200 provided to be linked to the continuous casting device 100 to receive the steel sheet 2; and a push-heat unit 300 linked to at least one of the continuous casting device 100 and the hot roller 200 and is provided to selectively perform one of a heating operation and a removal operation on some of the steel sheet 2.

Further, the hot roller 200 of the continuous casting and rolling apparatus 1 according to an aspect of the present invention includes a first rolling section 210 provided to be connected to a rear end of the continuous casting device 100, and a second rolling section 220 provided to be connected to a rear end of the first rolling section 210, and the push-heat unit 300 may be provided in at least one of a portion between the rear end of the continuous casting device 100 and a front end of the first rolling section 210, and a portion between the rear end of the first rolling section 210 and a front end of the second rolling section 220.

The continuous casting device 100 can serve to produce a steel sheet 2 from molten steel through the casting process. That is, the continuous casting device 100 supplies the molten steel from a tundish to a mold, and the supplied molten steel forms the steel sheet 2, while being deprived of a quantity of heat, and the steel sheet 2 is guided and moved by a guide roll and can be supplied to the hot roller 200 to be described later.

However, because the continuous casting device 100 produces the steel sheet 2 depending on the solidification rate of the molten steel, it is difficult to adjust the production rate. Therefore, when continuously receiving the steel sheet 2 produced by the continuous casting device 100 and pressing by the hot roller 200 to be described later to produce the rolled steel sheet 2, there is a limitation in terms of speed. However, when continuously performing rolling by being connected to the continuous casting device 100, there is an advantage capable of maximally utilizing the latent heat of the steel sheet 2 discharged from the continuous casting device 100.

Meanwhile, when the steel sheet 2 produced by the continuous casting device 100 is discontinuously provided to the hot roller 200 to produce the rolled steel sheet 2, the hot roller 200 can rapidly perform the rolling operation independently of the production speed of the continuous casting device 100 to produce a rolled steel sheet 2. However, since the rolling is performed discontinuously by the continuous casting device 100, there is a limitation which is incapable of maximally utilizing the latent heat of the steel sheet 2 discharged from the continuous casting device 100.

In this way, the process of turning the steel sheet 2 produced by the continuous casting device 100 into the rolled steel sheet 2 by the hot roller 200 can be distinguished by an endless rolling mode and a batch rolling mode, and the rolling operation can be performed, while varying the rolling production modes.

However, when varying the operation modes, there is a problem of a degradation of the quality of the rolled steel sheet 2. The defective steel sheet 2 needs to be removed to solve this problem, and the defective steel sheet 2 can be removed by the push-heat unit 300 to be described later.

Also, further, the steel sheet 2 produced in the continuous casting device 100 needs to be heated by the hot roller 200 to be described later to a temperature allowing steel sheet 2 to be rolled, and the push-heat unit 300 can also perform such a heating function.

The hot roller 200 can serve to receive the steel sheet 2 produced by the continuous casting device 100 and to press the case slab 2 down, thereby producing the rolled steel sheet 2. To this end, the hot roller 200 can press the steel sheet 2 down, while causing the steel sheet 2 to pass between a pair of rolling rolls, and a plurality of pairs of rolling rolls can be provided.

Furthermore, the hot roller 200 can be independently provided in a first rolling section 210 and a second rolling section 220, depending on the positions being provided.

Here, the first rolling section 210 is the hot roller 200 provided to be connected to the rear end as an output side of the continuous casting device 100, and produces the rolled steel sheet 2 in conjunction with the second rolling section 220 in the endless rolling mode. That is, because the rolling process is performed in the endless rolling mode, by utilizing the steel sheet 2 connected to the continuous casting device 100, when suddenly performing rolling on the steel sheet 2, the continuous casting device 100 is influenced. Thus, a first rolled steel sheet 2 of a constant thickness is produced in the first rolling section 210, and the finished second rolled steel sheet 2 is produced in the second rolling section 220.

However, the first rolling section 210 can also produce the rolled steel sheet 2 in the batch rolling mode in conjunction with the second rolling section 220, without being limited to be used only in the endless rolling mode.

In particular, the first rolling section 210 performs a sequential rolling operation, at the time of variation from the batch rolling mode to the endless rolling mode.

That is to say, the rolling operation is initially performed using the cut steel sheet (slab: 2) provided by cutting the steel sheet 2 in the batch rolling mode. After transition to the endless rolling mode, when the first rolling section 210 continuously receives the provision of the steel sheet 2 produced in the continuous casting device 100, the first rolling section 210 suddenly presses the steel sheet 2 down. Accordingly, since the continuous casting device 100 is influenced, a strap is generated, while the steel sheet 2 is pushed, thereby causing defects in the steel sheet 2.

To prevent these defects, the first rolling section 210 sequentially reduces a gap between the pair of rolling rolls to perform the sequential hot-rolling when switching from the batch rolling mode to endless rolling mode.

However, when performing such a sequential rolling, a steel sheet 2 including a thickness transition zone in which the thickness of the first rolled steel sheet 2 produced by the first rolling section 210 becomes gradually thinner is produced, which degrades the quality of the rolled steel sheet 2.

In order to remove such a defective steel sheet 2, a push-heat unit 300 to be described later may be provided. Further, the push-heat unit 300 may also serve to heat the steel sheet 2 to the temperature for rolling in the second rolling section 220 provided at the rear end of the first rolling section 210.

Meanwhile, a holding furnace (HF) for heat insulation may be provided at the front end as the input side of the first rolling section 210, and the holding furnace is intended to provide the steel sheet 2 provided by the heating means including the continuous casting device 100 or a push-heat unit 300 to be described later to the first rolling section 210, while maintaining the temperature of the steel sheet 2.

The second rolling section 220 can serve to directly receive the first rolled steel sheet 2 produced in the first rolling section 210 or the steel sheet 2 produced in the continuous casting device 100, and to produce a final second rolled steel sheet 2. The second rolling section 220 also presses the steel sheet 2 down while being moved between a pair of rolling rolls to produce the rolled steel sheet 2, and the rolled steel sheet 2 thus produced is wound around a rewinder R and is finally discharged.

To this end, the second rolling section 220 can be provided to be connected to a rear end as an output side of the first rolling section 210.

Meanwhile, a side guide before transmitting the steel sheet 2 to the first rolling section 210 or the second rolling section 220, in order to remove the scale and the like adhering to the steel sheet 2, a scale cleaner (SC) may be provided. That is, the scale cleaner SC can provided at the rear end of the push-heat unit 300 to be described later and at the front end of the first rolling section 210 or the second rolling section 220.

Further, a side guide (SG) may also be provided between the first rolling section 210 and the second rolling section 220 at the rear end of the scale cleaner SC, and the side guide is intended to improve the quality of rolling by providing the steel sheet 2 provided to the second rolling section 220 in an arranged manner.

Moreover, the rolled steel sheet 2 finally rolled through the second rolling section 220 is cut by a cutter (C) installed at the rear end of the second rolling section 220 and is wound around the rewinder R, and then it can be discharged as a final coil product.

The push-heat unit 300 can serve to heat the steel sheet 2 or to cut and remove some of the steel sheet 2. In particular, the push-heat unit 300 can set a shorter layout, as compared to a case in which the layout of the conventional continuous casting and rolling equipment was long, by providing a conventional heating means for heating and a removal means for removing the steel sheet 2 in different portions of the transport path of the steel sheet 2.

To this end, the push-heat unit 300 may include a heater 310 and a remover 320, and the heater 310 and the remover 320 can be provided on both sides of the same position on the path in the transport direction x of the steel sheet 2. Such a push-heat unit 300 will be described in detail later with reference to FIGS. 3, 7*a* to 7*c* and 8*a* to 8*c*.

FIG. 3 is a plan view illustrating the push-heat unit 300 in the continuous casting and rolling apparatus 1 of the present invention, FIGS. 7*a* to 7*c* are plan views illustrating an operating state of the push-heat unit 300, and FIGS. 8*a* to 8*c* are graphs illustrating the temperature change of the steel sheet 2 depending on the position of the continuous casting and rolling apparatus 1 by comparison of a prior art and the present invention.

Here, FIG. 7*a* illustrates that the heater 310 of the push-heat unit 300 is provided on the transport path of the steel sheet 2, FIG. 7*b* illustrates that the remover 320 of the push-heat unit 300 is provided on the transport path of the steel sheet 2, and FIG. 7*c* illustrates that both of the heater 300 and the remover 320 of the push-heat unit 310 are provided by deviating from the transport path of the steel sheet 2.

Also, FIG. 8*a* illustrates a temperature distribution depending on the transport position of the steel sheet 2 produced by the continuous casting and the rolling apparatus of the present invention, FIG. 8*b* illustrates a temperature distribution corresponding to the transport position of the steel sheet 2 produced by the prior art, and FIG. 8*c* is a graph illustrating a temperature change, when the same heat holding effect as the continuous casting and hot roller 1 of the present invention is generated by putting an additional quantity of heat to the apparatus according to the prior art.

Referring to FIGS. 3, 7*a* to 7*c* and 8*a* to 8*c*, the push-heat unit 300 of the continuous casting and rolling apparatus 1 according to an embodiment of the present invention may include a heater 310 provided on one side in a widthwise direction y of the steel sheet 2 to move from one side to the other side in the widthwise direction y of the steel sheet 2 so as to heat the steel sheet 2, and a remover 320 provided on the other side of the steel sheet 2 in the widthwise direction y to move from the other side to one side of the steel sheet 2 in the widthwise direction y so as to remove the cut steel sheet 2 cut by a cutter C located at a rear end of a first rolling section 210 linked to a rear end of the continuous casting device 100.

Further, the push-heat unit 300 of the continuous casting and rolling apparatus 1 according to an embodiment of the present invention may provide the heater 310 and the remover 320 to face each other on opposite sides of the same position in the transport direction x of the steel sheet 2.

That is, by providing the push-heat unit 300 capable of heating the steel sheet 2 or performing a role of cutting and removing some of the steel sheets 2 in the same location, it is possible to set a shorter layout as compared to the layout of the conventional continuous casting and rolling equipment. To this end, the push-heat unit 300 may include the heater 310 and the remover 320.

The heater 310 may serve to heat the steel sheet 2, thereby making it possible to carry out operations in the endless rolling mode and the batch rolling mode by raising the steel sheet 2 to the temperature for rolling.

In particular, the heater 310 may be provided to be movable onto the movement path of the steel sheet 2, and may be provided on both sides of the same position as the remover 320 to be described later, accordingly. That is, the heater 310 can be provided on one side of the steel sheet 2 to move from one side to the other side in the widthwise direction y of the steel sheet 2, and the remover 320 can be provided on the other side of the steel sheet 2 on an opposite side of the heater 310 so as to face the heater 310.

Thus, the continuous casting and rolling apparatus 1 of the present invention can reduce the layout over an entire length, as compared to the prior art, which makes it possible to reduce the heat loss. That is, there is a need for maintenance of the temperature for the rolling process in the process of the steel sheet 2 produced and provided in the continuous casting device 100 being produced as a rolled steel sheet 2 while passing through the hot roller 200.

At this time, when the entire layout of the continuous casting and rolling apparatus 1 is reduced, the portion and the time of generation of heat release can be reduced, which makes it possible to reduce final heat loss.

This can also be seen in the graphs provided in FIGS. 8*a* to 8*c*. That is, FIG. 8*a* illustrates temperature distribution for each layout position according to the present invention, and FIG. 8*b* illustrates temperature distribution for each position according to the layout of the existing device.

Here, a first point P1 is a temperature before entering the first rolling section 210, and a second point P2 is at a temperature after discharge from the first rolling section 210. Further, a third point P3 is a temperature before entering the heater 310, a fourth point P4 is a temperature after discharge from the heater 310, and a fifth point P5 is a temperature upon finally exiting the layout.

Here, the temperature of the rolled steel sheet 2 rolled and discharged to the fifth point P5 is particularly important part. That is, when mainly considering an average temperature of the steel sheet 2, the temperature of the fifth point P5 of the continuous casting and rolling apparatus 1 of the present invention may be discharged while being maintained to be higher than the temperature $T_5$ of an existing device by approximately 5 to 10° C. This is a portion in which it is possible to check that the temperature for rolling is satisfactorily maintained as compared to the prior art.

Moreover, additional heating is required in order that the existing devices is provided so as to be maintained at the same temperature as the continuous casting and rolling apparatus 1 of the present invention, which can be checked in the graph of FIG. 8*c*.

That is, the continuous casting and rolling apparatus 1 of the present invention supplies power of 2 MW to the push-heat unit 300 provided at the front end as the input side of the second rolling section 220. At this time, when the same power of 2 MW is supplied to the heating means of the existing device, the temperature of the fifth point P5 is formed to be low by about 5 to 10° C. At this time, when additional power of 0.4 MW is further supplied to the heating means of the existing device, as illustrated in FIG. 8*c*, the temperature of the fifth point P5 can be formed at the same temperature as the continuous casting and rolling apparatus 1 of the present invention.

That is to say, the present invention can reduce the layout of the entire apparatus, by providing the push-heat unit 300 that provides the heater 310 and the remover 320 at the same location, thereby being able to generate an effect capable of reducing the power of 0.4 mW (about 20%) as compared to the prior art.

When such an effect temperature is also compared at other points, it is possible to check that the continuous casting and rolling apparatus 1 can maintain a higher temperature than a temperature $T_3$ of the existing device by about 17 to 21° C. at the third point P3, and can maintain a higher temperature than the temperature $T_4$ of the existing device by about 16 to 20° C. in the fourth point P4.

Specifically, as a configuration for reducing the overall layout of the continuous casting and rolling apparatus 1, the push-heat unit 300 provides the heater 310 and the remover 320 at the same position in the transport direction x of the steel sheet 2.

That is, the heater 310 can be provided such that it can move from one side to the other side of the steel sheet 2 to heat the steel sheet 2, and can be provided on one side of the steel sheet 2.

Meanwhile, the remover 320 can be provided such that it can move from the other side to one side of the steel sheet 2 in order to cut and remove some of the steel sheet 2, and can be provided on the other side of the steel sheet 2.

In particular, in order to reduce the overall layout of the continuous casting and rolling apparatus 1, the heater the 310 and the remover 320 can be provided on both sides of the same position in the transport direction x of the steel sheet 2. That is, it is possible to reduce the overall layout, by reducing the length as much as a region in which the heater 310 is provided in the transport direction x of the steel sheet 2 or a region in which the remover 320 is provided.

Here, because the heater 310 and the remover 320 may be provided by being selectively moved on the transport path of the steel sheet 2, it is also possible to prevent a collision with the steel sheet 2 in advance.

That is, the steel sheet 2 may be vertically bent or horizontally vent by weight thereof, while a thickness thereof is reduced via a high temperature or rolling. At this time, since the heater 310 and the remover 320 are provided to deviate from the transport path of the steel sheet 2, it is possible to prevent collisions with the steel sheet 2 in advance.

To this end, each of the heater 310 and the remover 320 selectively move onto the transport path of the steel sheet only when heating is required in the steel sheet 2 to perform the function.

That is, since a case in which the heater 310 and the remover 320 are simultaneously used is eliminated, as illustrated in FIG. 7*a*, when using the heater 310, the remover 320 deviates from the transport path of the steel sheet 2. As illustrated in FIG. 7*b*, when using the remover 320, the heater 310 may be provided to deviate from the transport path of the steel sheet 2. As illustrated in FIG. 7*c*, when both of the heater 310 and the remover 320 are not used, both of the heater 310 and the remover 320 may be provided to deviate from the transport path of the steel sheet 2.

Here, the heater 310 can provide a coil section 311 and a coil transport section 312 for heating the steel sheet 2, and a detailed explanation thereof will be described later with reference to FIG. 5.

Further, the remover 320 can provide a support section 321, a vertical transport section 322 and a horizontal transport section 323 to remove some of the steel sheet 2, and a detailed explanation thereof will be described later with reference to FIG. 6.

FIG. 5 is a front view illustrating the heater 310 in the continuous casting and rolling apparatus 1 of the present invention. Referring to FIG. 5, the heater 310 of the continuous casting and rolling apparatus 1 according to an embodiment of the present invention includes a coil section 311 that is connected a power supply unit PS and provided to regulate the heating temperature, and a coil transport section 312 that moves the coil section 311 in the widthwise direction y of the steel sheet 2.

Further, the coil section 311 of the continuous casting and rolling apparatus 1 according to an embodiment of the present invention may include a core 311*a* provided in a "U" shape to heat a top and a bottom of the steel sheet 2, and a coil 311*b* which is provided by being wound around the core.

That is, the heater 310 can provide the coil section 311 and the coil transport section 312 to move to the steel sheet 2 and to heat the steel sheet 2.

The coil section 311 serves to heat the steel sheet 2 by induction heating, and to this end, the coil section 311 can be provided to be connected to the coil transport section 312 to be described later. Thus, the coil section 311 heats the steel sheet 2, and at this time, since the coil section 311 performs the induction heating, it is possible to control the heating amount.

To this end, the coil section 311 can provide the core 311*a* and the coil 311*b*, the core 311*a* can be provided in a "U" shape, and the coil 311*b* can be provided by being wound around the core 311*a*.

That is, as illustrated in (a) of FIG. 5, the coil 311*b* can also be provided by being wound around the core 311*a* in the direction x parallel to the steel sheet 2, and as illustrated in (b) of FIG. 5, the coil 311*b* can also be provided by being wound around the core 311*a* in a direction z perpendicular to the steel sheet 2.

Here, because the core 311*a* is provided by being inserted into the side surface of the steel sheet 2 in a "U" shape, the core 311*a* simultaneously heats the upper and lower surfaces of the steel sheet 2 to generate an advantage of even heating.

The coil transport section 312 can serve to move the coil section 311 from one side to the other side of the steel sheet 2. To this end, the coil transport section 312 is provided as a hydraulic or pneumatic cylinder and may be provided so as to be connected to the coil section 311.

Such a coil section 311 and the coil transport section 312 are connected to the control unit 330 to adjust the heating amount or the movement amount, and may be connected the power supply unit PS.

FIG. 6 is a front view illustrating the remover 320 in the continuous casting and rolling apparatus 1 of the present invention. Referring to FIG. 6, the remover 320 of the continuous casting and rolling apparatus 1 according to an embodiment of the present invention may include a support section 321 provided to support the cut steel sheet 2 in contact with the bottom of the cut steel sheet 2, a support vertical transport section for vertically moving the support section 321, and a horizontal transport section 323 for moving the support section 321 in the widthwise direction y of the steel sheet 2.

That is, the remover 320 can provide the support section 321, the vertical transport section 322 and the horizontal transport section 323 to move to the steel sheet 2 and remove some of the steel sheet 2.

In particular, since the remover 320 may be provided to move to the transport path of the steel sheet 2 only when necessary, it is possible to avoid interference with the steel sheet 2, and by being provided on the other side of the moving path of the steel sheet 2 at the same position as the heater 310, it is possible to reduce the layout of the continuous casting and rolling apparatus 1 of the present invention.

Here, the remover 320 is necessary to cut and remove the portion of the defective steel sheet 2 in the steel sheet 2. Such a defective steel sheet 2 may include a defective steel sheet 2 which does not reach the required state at the initial continuous casting using the continuous casting device 100, or a defective steel sheet 2 with the gradually thinner thickness that occurs when switching from the batch rolling mode to the endless rolling mode.

Thus, the remover 320 is temporarily necessary in order to remove the defective steel sheet 2, and may include a cutter C for cutting the defective steel sheet 2. The cut defective steel sheet 2 can be removed by the support section 321, the vertical transport section 322 and the horizontal transport section 323.

The support section 321 is provided to be in contact with the lower surface of the cutting steel sheet 2, and can be provided to be moved by the vertical transport section 322 and the horizontal transport section 323.

Here, the support section 321 can provide a contact plate 321*a*, a base plate 321*b* and a guide tab 321*c* in order to vertically transport the cut steel sheet 2 by the vertical transport section 322.

That is, the contact plate 321*a* is a portion that is in contact with the cut steel sheet 2, the base plate 321*b* is a portion that is connected to the horizontal transport section 323 and to which the vertical transport section 322 is coupled. Further, on the side surface of the base plate 321*b*, a guide tab 321*c* for guiding the contact plate 321*a* may be formed so that the contact plate 321*a* is vertically moved by receiving the transmission of the driving force by the vertical transport section 322.

That is to say, a side wall can be formed in the base plate 321*b* in the vertical direction z, the guide tab 321*c* can be formed and provided on the side wall, and the contact plate 321*a* can be provided by the formation of a guide groove having a shape corresponding to the guide tab 321*c* so that the guide tab 321*c* can be inserted into the guide groove.

The vertical transport section 322 may be provided as a hydraulic or pneumatic cylinder, one end portion thereof can be provided by being coupled to the inner surface of the base plate 321*b*, and the other end portion thereof is coupled to the contact plate 321*a* to provide a driving force capable of vertically moving the contact plate 321*a*.

The horizontal transport section 323 can serve to move the support section 321 from the other side to one side in the transport direction x of the steel sheet 2 so as to provide the support section 321 to the transport path of the steel sheet 2. To this end, the horizontal transport section 323 can be provided as a hydraulic or pneumatic cylinder and is coupled to the base plate 321*b* to transmit the driving force capable of moving the base plate 321*b* to the left-right side of the steel sheet 2 in the widthwise direction y.

Further, the vertical transport section 322 and the horizontal transport section 323 are connected to the control unit 330 to adjust the traveled distance, and are connected to the power supply unit PS to receive the supply of power.

FIGS. 9 and 10 are flow charts illustrating a continuous casting and rolling method of the present invention, FIG. 9 is a flowchart illustrating an overall continuous casting and rolling step, and FIG. 10 is a flowchart illustrating only the selectively performed step.

Referring to FIGS. 9 and 10, a continuous casting and rolling method according to another embodiment of the present invention may include a continuous casting step of producing a steel sheet 2; a rolling step of pressing the steel sheet down 2; and a selectively performed step of selectively determining whether to perform one of a heating operation and a removal operation on some of the steel sheet 2, at the same position on the transport path of the steel sheet 2.

Further, the selectively performed step of the continuous casting and rolling method according to another embodiment of the present invention may selectively activate a heating step of heating a portion of the steel sheet 2, a removal step of removing the cut steel sheet 2 obtained by the cutting of some of the steel sheet 2 in the transport direction x of the steel sheet, and a standby step of not performing the heating step and the removal step.

Further, the rolling step of the continuous casting and rolling method according to another embodiment of the present invention may include a first rolling step, and a second rolling step performed after the first rolling step, wherein the selectively performed step may be performed prior to at least one of the first rolling step and the second rolling step.

The continuous casting step is a step of producing a steel sheet 2 by the continuous casting device 100 and receiving the molten steel by the continuous casting to provide the steel sheet 2. The defective steel sheet 2 failed to reach the required state is produced in the initial continuous casting, and cut and removed by the remover 320 of the push-heat unit 300 connected to the rear end of the continuous casting device 100 in the selectively performed step.

The selectively performed step is a step of selectively performing the heating step and the removal process of the steel sheet 2. That is, the above-mentioned selectively performed step is a step of selectively performing one of the heating step, the removal step and the standby step.

Here, the heating step is a step of heating the steel sheet 2 to a temperature for rolling by the heater 310 of the push-heat unit 300, the removal step is a step of removing the defective steel sheet 2 in the steel sheet 2 by the remover 320 of the push-heat unit 300, and the standby step is a step of neither heating nor removing the steel sheet 2.

Although the selectively performed step can selectively perform the heating step, the removal step and the standby step, since it is desirable not to perform the rolling in the defective steel sheet 2 removed in the removal step, there the heating step for rolling is not required, and it is desirable to selectively perform the operation of heating or removal.

By selectively performing one of the heating step, the removal step and the standby step in a single selectively performed step, it is possible to reduce the overall layout of the aforementioned continuous casting apparatus, thereby reducing the heat loss of the rolled steel sheet 2.

The rolling step is a step of receiving the steel sheet 2 produced by the continuous casting step and pressing the steel sheet down to produce a rolled steel sheet 2. The rolling step is desirably provided at the desired temperature for rolling in order to produce a rolled steel sheet 2 with excellent quality.

Here, the rolling step can press the steel sheet separately into the first rolling step and the second rolling step to prevent an influence on the continuous casting device 100 in the endless rolling mode of manufacturing the rolled steel sheet 2, while continuously receiving the steel sheet 2 produced in the continuous casting step.

That is, the first rolling step is a coarse rolling step provided by pressing the steel sheet down 2 to form only the thickness of the constant portion before forming the final thickness of the rolled steel sheet 2, and the second rolling step is a finishing rolling step producing a final second rolled steel sheet 2 by pressing down the first rolled steel sheet 2 after passing through the first rolling step.

The first rolling step may be performed after the continuous casting step, and the second rolling step may be performed after the first rolling step. However, in order to improve the quality of the rolled steel sheet 2, the selectively performed step may be performed between the continuous casting step and the first rolling step, and may be performed between the first rolling step and the second rolling step.

The invention claimed is:

1. A continuous casting and rolling apparatus comprising:

a continuous casting device producing a steel sheet;

a hot roller provided to be linked to the continuous casting device to receive the steel sheet; and a push-heat unit linked to at least one of the continuous casting device and the hot roller and is provided to selectively perform one of a heating operation and a removal operation on some of the steel sheet, wherein the push-heat unit comprises:

a heater provided on one side of the steel sheet in a widthwise direction to move from one side to the other side of the steel sheet in the widthwise direction so as to heat the steel sheet; and a remover provided on the other side of the steel sheet in the widthwise direction to move from the other side to one side of the steel sheet in the widthwise direction so as to remove a cut steel sheet that is cut by a cutter located at a rear end of a first rolling section linked to a rear end of the continuous casting device, and wherein the push-heat unit provides the heater and the remover to face each other on both sides of a same position in a transport direction of the steel sheet.

2. The continuous casting and rolling apparatus of claim 1, wherein the heater comprises:

a coil section provided by being connected to a power supply unit to control a heating temperature; and a coil transport section that moves the coil section of the steel sheet in the widthwise direction.

3. The continuous casting and rolling apparatus of claim 2, wherein the coil section comprises:

a core provided in a "U" shape to heat a top and a bottom of the steel sheet; and a coil which is provided by being wound around the core.

4. The continuous casting and rolling apparatus of claim 1, wherein the remover comprises:

a support section provided to support the cut steel sheet in contact with the bottom of the cut steel sheet;

a support vertical transport section that vertically moves the support section; and a horizontal transport section that moves the support section of the steel sheet in the widthwise direction.

5. The continuous casting and rolling apparatus of claim 1, wherein the hot roller comprises a first rolling section provided to be connected to the rear end of the continuous casting device, and a second rolling section provided to be connected to the rear end of the first rolling section, and the push-heat unit is provided in at least one of a portion between the rear end of the continuous casting device and a front end of the first rolling section, and a portion between the rear end of the first rolling section and a front end of the second rolling section.

* * * * *